US008932079B2

(12) United States Patent
Marsh

(10) Patent No.: US 8,932,079 B2
(45) Date of Patent: Jan. 13, 2015

(54) COAXIAL CONNECTOR AND METHOD OF ASSEMBLING ONE

(75) Inventor: John Marsh, London (GB)

(73) Assignee: Tyco Electronics UK Ltd, Swindon, Wiltshire (GB)

( * ) Notice: Subject to any disclaimer, the term of this patent is extended or adjusted under 35 U.S.C. 154(b) by 173 days.

(21) Appl. No.: 13/264,613

(22) PCT Filed: Apr. 12, 2010

(86) PCT No.: PCT/EP2010/054761
§ 371 (c)(1),
(2), (4) Date: Oct. 14, 2011

(87) PCT Pub. No.: WO2010/119011
PCT Pub. Date: Oct. 21, 2010

(65) Prior Publication Data

US 2012/0040557 A1 Feb. 16, 2012

(30) Foreign Application Priority Data

Apr. 15, 2009 (GB) ..... 0906474.2

(51) Int. Cl.
*H01R 9/05* (2006.01)
*H01R 24/38* (2011.01)
*H01R 103/00* (2006.01)

(52) U.S. Cl.
CPC ..... *H01R 9/0503* (2013.01); *H01R 9/0518* (2013.01); *H01R 24/38* (2013.01); *H01R 2103/00* (2013.01); *Y10S 439/907* (2013.01)
USPC ..... 439/585; 439/63; 439/675; 439/907

(58) Field of Classification Search
USPC ..... 439/63, 578, 583, 585, 675, 901
See application file for complete search history.

(56) References Cited

U.S. PATENT DOCUMENTS 5,501,615 A * 3/1996 Inaba et al. ..... 439/578
5,817,978 A 10/1998 Hermant et al.

(Continued)

FOREIGN PATENT DOCUMENTS

EP 0393495 A1 10/1990
EP 0450988 A1 10/1991

(Continued)

OTHER PUBLICATIONS

International Preliminary Report on Patentability issued by The International Bureau of WIPO, Geneva, Switzerland, dated Oct. 18, 2011, for related International Application No. PCT/EP2010/054761; 8 pages.

(Continued)

*Primary Examiner* — James Harvey
(74) *Attorney, Agent, or Firm* — Faegre Baker Daniels LLP

(57) ABSTRACT

A straight electrical coaxial cable connector (2) for connecting first and second coaxial cables (8, 10) each including a core (16, 24) and a shield layer (20, 28), the connector (2) including first and second interengeagable housing parts (68, 70), first and second crimp ferrules (34, 52) for respectively engaging the shield layers (20, 28) of the first and second cables (8, 10), shield connection means (38) for electrically interconnecting the first and second shield layers (20, 28), core connection means (36, 64) for electrically interconnecting the two cores (16, 24), and first and second ferrule engagement means (76, 88) operable to respectively secure the first and second ferrules (34, 52) relative to respective said housing parts (68, 70).

26 Claims, 6 Drawing Sheets

(56) References Cited

U.S. PATENT DOCUMENTS

| | | | | |
|---|---|---|---|---|
| 5,911,599 | A | 6/1999 | Masuda | |
| 5,934,937 | A | 8/1999 | McCarthy | |
| 6,702,611 | B1 * | 3/2004 | Miyazaki et al. | 439/559 |
| 7,544,105 | B2 * | 6/2009 | Stagi et al. | 439/784 |
| 2008/0233791 | A1 | 9/2008 | Hanks | |
| 2012/0040557 | A1 * | 2/2012 | Marsh | 439/585 |

FOREIGN PATENT DOCUMENTS

| | | | |
|---|---|---|---|
| EP | 0773602 | A2 | 5/1997 |
| EP | 1852949 | A1 | 11/2007 |
| EP | 1923961 | A2 | 5/2008 |
| WO | WO 2006/124409 | A2 | 11/2006 |

OTHER PUBLICATIONS

International Search Report and Written Opinion issued by the European Patent Office, dated Jul. 12, 2010, for related International Application No. PCT/EP2010/054761; 12 pages.

Search Report issued by the UK Intellectual Property Office, South Wales, dated Aug. 10, 2009, for Priority Application No. GB 0906474.2; 3 pages.

* cited by examiner

COAXIAL CONNECTOR AND METHOD OF ASSEMBLING ONE

CROSS REFERENCE TO RELATED APPLICATIONS

This application was filed on Oct. 14, 2011, U.S. application Ser. No. 13/264,613, and is the National state entry of PCT/EP2010/054761, International Filing Date Apr. 12, 2010, which claims the foreign priority benefit of 0906474.2, filed on Apr. 17, 2009.

BACKGROUND

The present invention relates to a straight connector for interconnecting two coaxial cables and to a method of interconnecting two such cables.

SUMMARY

Existing straight connectors for connecting two coaxial cables generally include a pair of housings parts in each of which a cable sub-assembly, at the end of a cable, is mounted such that when the housing parts are interengaged core and shield portions of one cable sub-assembly are brought into engagement with those of the other cable sub-assembly. Latch and terminal position assurance devices for holding complementary core connection members of the terminal sub-assemblies firmly in engagement with each other result in the sub-assemblies being bulky. This in turn results in the overall outer dimensions of the connector being larger than is desirable. One preferred object of the invention is to reduce the overall size of the cable sub-assembly and also preferably the overall size of the connetor.

Thus according to a first aspect of the invention there is provided a straight electrical coaxial cable connector for connecting first and second coaxial cables each including a core and a shield layer, the connector including first and second interengeagable housing parts, first and second crimp ferrules for respectively engaging the shield layers of the first and second cables, shield connection means for electrically interconnecting the first and second shield layers, core connection means for electrically interconnecting the two cores, and first and second ferrule engagement means operable to respectively secure the first and second ferrules relative to respective said housing parts. Securing each cable to its associated housing part by means of a ferrule engagement means removes the necessity for a latch or terminal position assurance device on the core connection, permitting the cable sub-assembly to be smaller. This in turn permits the housing parts to be smaller also. The mating and unmating load on the core connection are transmitted to the housing latch via the cable crimp and ferrule. As an alternative to the first and second ferrule engagement means for securing the first and second ferrules relative to the housing parts, engagement of parts other than the core connection means is possible to secure the core connection means in engagement. For example engagement of the shield connection means is possible as an alternative. The intention is that direct latching of the core connection means is not required as the mating and unmating loads are transmitted via the cables and cable crimps.

Preferably each ferrule engagement means is integrally formed with one of said housing parts. Such an arrangement will reduce the number of part required for the manufacture of the connector.

To guard against accidental release of the ferrule engagement means and unintentional release of the cable sub-assemblies, the connector preferably further includes at least one displaceable secondary lock or position assurance member which is engageable with a respective ferrule engagement means.

Conveniently the shield connection means comprises a tubular shield connection means which provides efficient all round shielding and facilitates fabrication of the connector.

In order to still further improve the shielding the tubular shield connection means may comprises a one-piece shield tube which extends from the first crimp ferrule to the second crimp ferrule. Such an arrangement also removes the need for a connection in the shield connection means which in turn enables the cable sub-assembly to be still more compact.

Preferably a cable sub-assembly of the connector includes tubular insulating means interposed between the shield connection means and the core connection means. This enables the assembly to be smaller as the required distance between the shield and the core, to provide electrical isolation, can be reduced.

To reduce the number of parts in the connector, the tubular insulating means preferably comprises a one-piece insulation tube which extends from the first crimp ferrule to the second crimp ferrule. This arrangement is particularly advantageous when the shield connection means comprises a one-piece tube since these tubes can be nested inside and support each other thus providing a relatively rigid extension of the cable sub-assembly.

In situations in which distal ends of the cable sub-assemblies may be subject being knocked, plug parts should be as robust as possible and accordingly should not include long extensions. For such applications the tubular insulation means preferably includes an insulation tube mounted in each housing part and forming part of a cable sub-assembly, the two insulation tubes including overlapping interengagement portions to help provide the required electrical creepage distance.

When the shield connection means and the insulating means each comprise a one-piece tube as described above the core connection means preferably includes two interengeagable core connector members each configured to be connected to a respective one of the cores and situated within the one-piece shield tube.

When the shield connection means comprises a one-piece tube which is engaged with one of the ferrules, upon mating of housing parts, preferably the relevant crimp ferrule comprises a main ferrule body and spring means arranged to bias the main ferrule body into engagement with the shield connection means. With such an arrangement a material such as copper can be used for both ferrules. While copper can provide a low resistance contact it tends to stress relax over time which could degrade contact between the ferrule and a shield connection means with which it slidingly engages upon mating of connector parts. The main ferrule body may include plural longitudinally extending engagement portions and the spring means may surround and inwardly bias the engagement portions.

In order for parts of the core connection means to be held firmly in engagement with each other as a result of the crimp collars being secured relative to the housing parts, a thrust collar is preferably interposed between at least one of the crimp ferrules and the respective core connector member for biasing the core connector members into engagement with each other. More preferably each crimp collar is provided with such a thrust collar. This arrangement prevents the core connection mating loads from being transmitted via the cables and cable crimps.

According to a second aspect of the invention there is provided a method of interconnecting two aligned coaxial electrical cables each including a core and a shield layer, the method comprising the steps of: (i) forming a cable sub-assembly at an end of each cable including engaging a crimp ferrule with the shield layer and joining a core connection member to the core of the respective cable; (ii) providing shield connection means for electrically interconnecting the shield layers; (iii) providing two interengageable housing parts; (iv) securing each cable sub-assembly relative to a respective housing part with an engagement means which engages one said crimp ferrule or said shield connection means; and (v) interengageing the housing parts such that the core connection members interconnect the cores and the shield connection means interconnects the shield layers. With such a method no direct latching of the core connection means is required.

Preferably the step of providing the shield connection means comprises providing a one-piece shield tube which extends from one crimp ferrule and is engageable with the other crimp ferrule when the housings are interengaged.

Preferably the step of forming each cable sub-assembly includes the step of positioning a thrust collar between the crimp ferrule and the core connection member which transfers load therebetween when the housing parts are interengaged. This prevents core connection mating loads from being transmitted via the cables and cable crimps.

BRIEF DESCRIPTION OF THE DRAWINGS

The invention will now be described by way of example only with reference to the accompanying drawings in which.

DETAILED DESCRIPTION

A straight coaxial connector according to a first embodiment of the invention, and a method of making it will be described in detail with reference to FIGS. 1 to 4.

Figure 3:
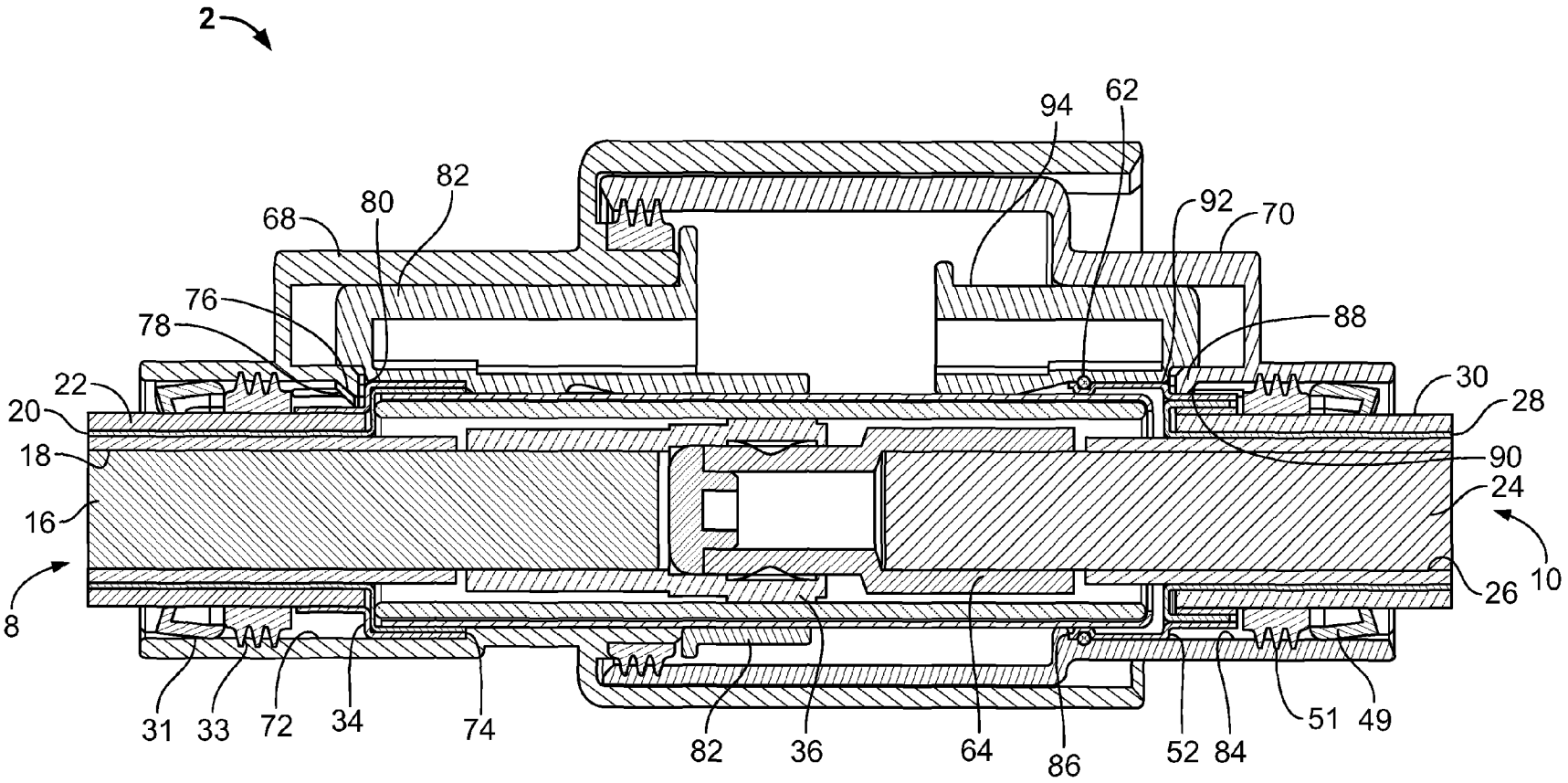
FIG. 3 shows a cross-section of a coaxial connector according to the first embodiment of the invention incorporating the sub-assemblies shown in FIGS. 1 and 2 in a connected state.
Figure 4:
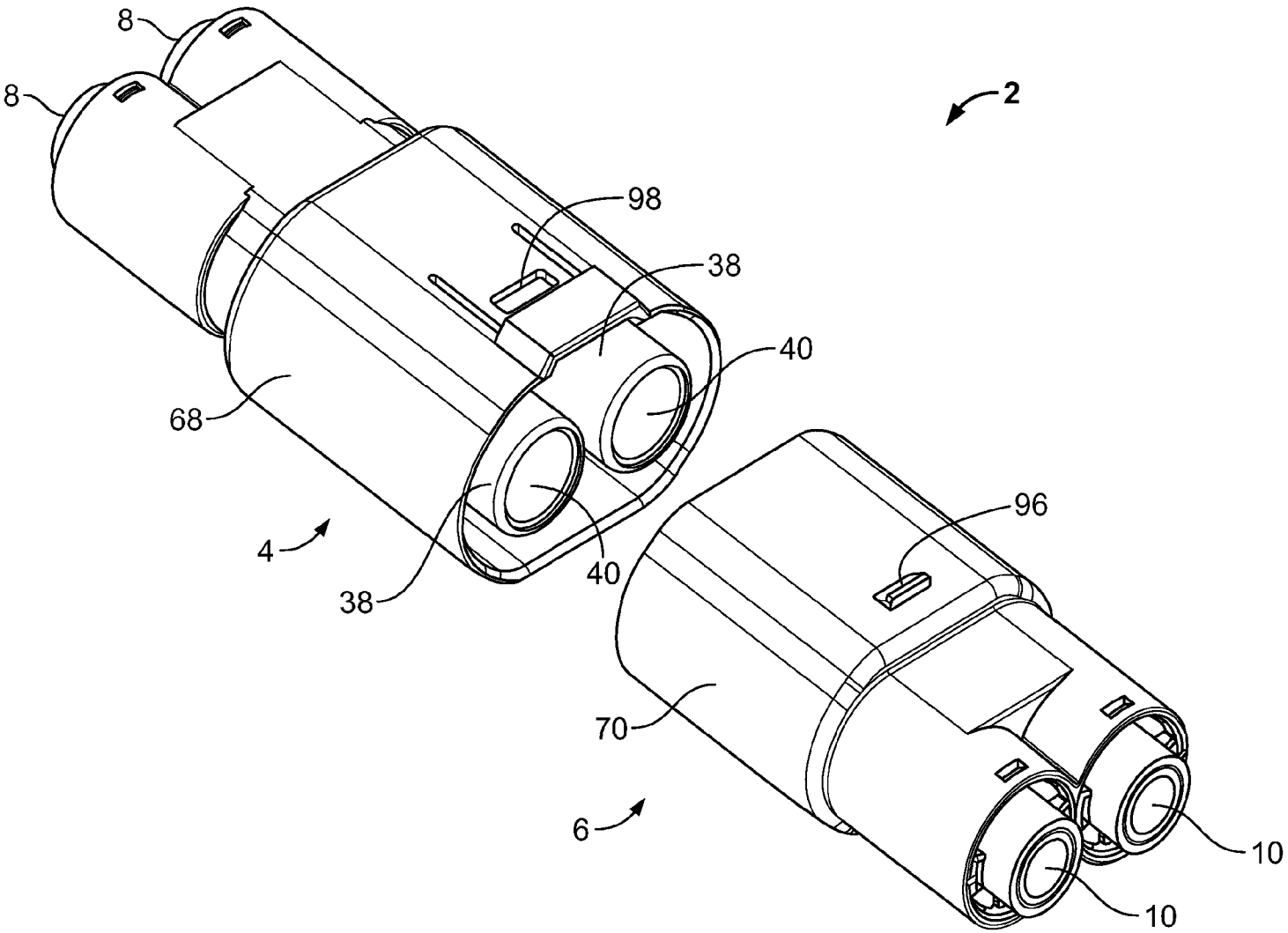
FIG. 4 shows a perspective view of the two parts of the coaxial connector shown in FIG. 3 prior to connection.

The connector 2 shown in FIGS. 3 and 4 comprises a first part 4 and a second part 6 which are interengageable with each other. The connector first part 4 is configured to be connected to two first coaxial cables 8 and the connector second part 6 is configured to be connected to two second coaxial cables 10. Each connector part could however be configured to be connected to a different number of coaxial cables such a one or more than two. Since the manner in which the two first coaxial cables 8 are connected to the connector first part 4 is the same, the connection of only one first coaxial cable 8 will be described in detail. Likewise for the connection of the second coaxial cables 10 to the connector second part 6.

Each first cable comprises a core 8, surrounded by a layer of inner insulation 18, surrounded by a shield layer in the form of braid 20, surrounded by a layer of outer insulation 22. Likewise each second cable 10 comprises a core 24, a layer of inner insulation 26, a shield layer in the form of braid 28 and a layer of outer insulation 30 arranged in a like manner. Ends of the first and second cables are formed respectively into first and second cable sub-assemblies 12 and 14 shown disengaged from each other in FIG. 2*a*, engaged with each other in FIGS. 1 and 2*b* and engaged with each other and incorporated into the coupled connector in FIG. 3.

Figure 1:
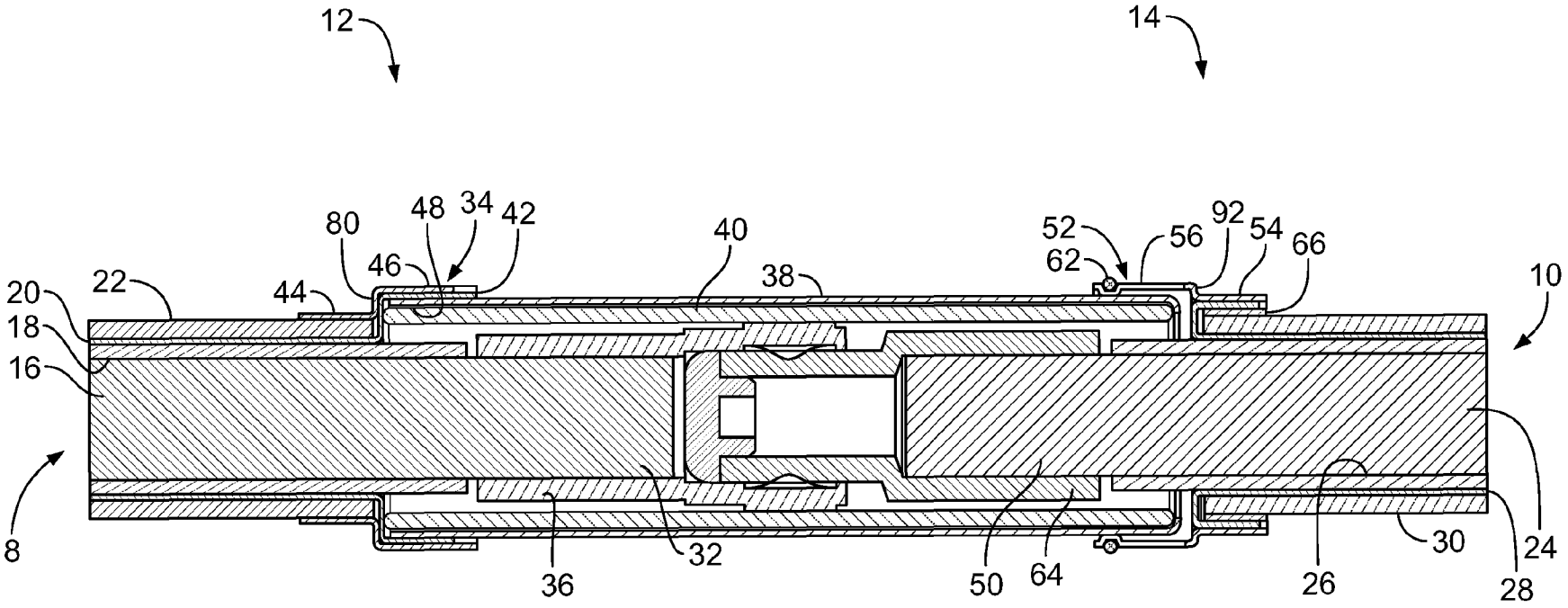
FIG. 1 shows two interengaged cable sub-assemblies which form part of a coaxial cable connector according to a first embodiment of the invention.

Prior to forming the first cable sub-assembly 12, a strain relief member 31 followed by a first cable seal 33, the functions of which will be described below, are threaded over an end portion of the first cable 8. To form the first cable sub-assembly 12 the outer insulation 22 is first stripped back from the end portion of the first cable 8. The braid 20 and inner insulation 18 are then stripped back such that portions thereof project from the outer insulation 22 and a core end 32 is exposed. A first crimp ferrule 34 is then threaded over the outer insulation 22 past the exposed braid 20 to a position to the left of where it is shown in FIG. 1. A first core connection means in the form of a first core connection member 36 is then slid over the core end 32 and crimped thereonto. An insulation tube 40 is then slid into a shield tube 38. These two tubes a substantially the same length. The exposed portion of the braid 20 is then formed outwardly into an outwardly formed braid portion shape shown in FIG. 1 and adjacent ends of the nested tubes 38 and 40 are inserted into the outwardly formed braid portion 42. The first crimp ferrule 34 is then slid along the first cable 8 such that a proximal portion 44 thereof overlies the outer insulation 22 and a distal portion 46 thereof overlies the outwardly formed braid portion 42 and ends of the insulation tube 40 and shield tube 38. The proximal part 44 of the first crimp ferrule 34 is then crimped inwardly such that it grips the cable 8 by pressing inwardly on the outer insulation 22. The distal part 46 of the first crimp ferrule 34 is then crimped inwardly such that the outwardly formed braid portion 42 is firmly sandwiched between the distal part 46 and the end 48 of the shield tube 38. These crimping steps may be performed simultaneously and are the final step in the formation of the first cable sub-assembly 12.

Prior to forming the second cable sub-assembly 14 a second strain relief member 49 followed by a second cable seal 51, the functions of which will be described below, are threaded over an end portion of the second cable 10. To form the second cable sub-assembly 14 the outer insulation 30 is first stripped back from an end portion of the second cable 10. The braid 28 and inner insulation 26 are then stripped back such that portions thereof still project from the outer insulation 30 and a core end 50 is exposed. A second crimp ferrule 52 is then threaded over the outer insulation 30 past the exposed braid 28 to a position to the right of where it is shown in FIG. 1. The second crimp ferrule 52 includes a proximal part 54 configured to overlie the outer insulation 30 and a distal part 56 configured to engage the shield tube 38 which together make up a main ferrule body. The distal part 56 includes longitudinally extending engagement portions in the form of engagement fingers 58. The engagement fingers are separated from each other by slots 60. End portions of the engagement fingers 58 are surrounded by spring means in the form of a ring spring which acts to bias the engagement fingers 58 inwardly. A second core connection means in the form of a second core connection member 36 is then slid over the core end 50 and crimped thereonto. An inner crimp collar 66 is then slid over an end of the outer insulation 30 and the exposed portion of the braid 28 is formed outwardly and doubled back over the inner crimp collar 66 as shown in FIG. 1. The second crimp ferrule 52 is then slid along the second cable 10 such that the proximal part 54 thereof overlies the outer insulation 30. The proximal part 54 of the second crimp ferrule 52 is then crimped inwardly such that it grips the cable 10 by pressing inwardly on the outer insulation 30. This crimping step is the final step in the formation of the second cable sub-assembly 14.

Figures 2A, 2B:
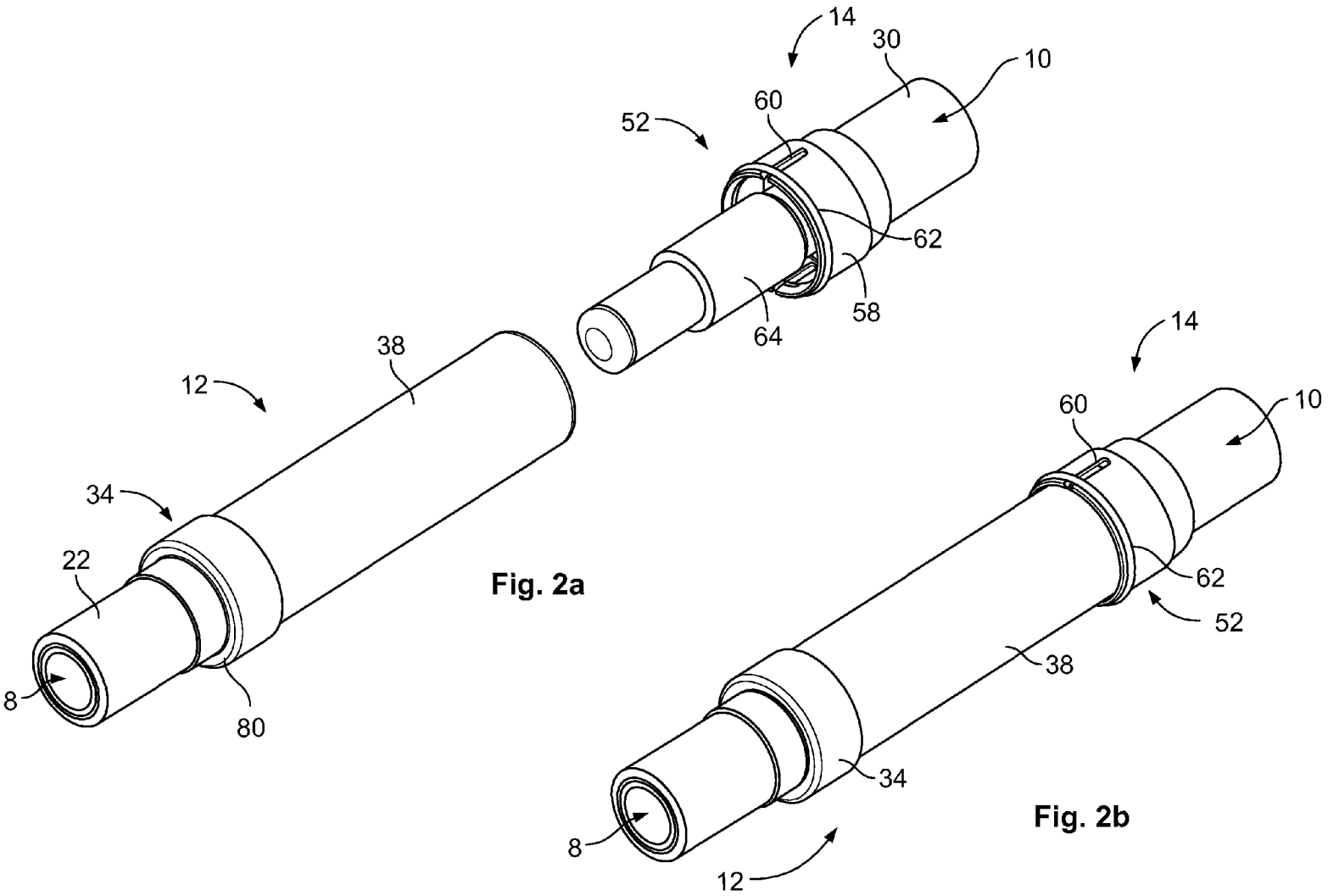
FIG. 2*a* shows the two sub-assemblies shown in FIG. 1 prior to interengagement.
FIG. 2*b* shows the two sub-assemblies shown in FIG. 1 after interengagement.

The first and second cable sub-assemblies 12 and 14, shown individually in FIG. 2*a*, are then respectively secured in first and second connector housings 68 and 70, shown in FIGS. 3 and 4.

The first connector housing 68 includes a passage 72 containing ferrule engagement means. The ferrule engagement means is in the form of an inwardly projecting ferrule stop shoulder 74 and a resilient and outwardly displaceable ferrule retaining latch 76 spaced therefrom which constitutes a primary latch. Both the shoulder 74 and the latch 76 are integrally formed with the connector housing 68. Other constructions are however possible. The ferrule retaining latch could for example be replaced with a latch member which is formed separately from the connector housing 68 and is engageable with the connector housing 68 and the first crimp ferrule 34 to hold it against the ferrule stop shoulder 74 to secure the first crimp ferrule 34 relative to the first connector housing 68. With the arrangement shown in FIG. 3, the first cable sub-assembly 12 is inserted into the first passage 72 until the first crimp ferrule 34 comes into contact with a sloping cam surface 78 of the latch 76. Further insertion of the first cable sub-assembly into the first connector housing 68 causes the latch 76 to be displaced outwardly until a leading end of the first crimp ferrule 34 comes into contact with the ferrule stop shoulder 74 at which point the latch resiles inwardly and engages a rearwardly facing shoulder 80 of the first crimp ferrule 34 situated between the distal part 46 and the proximal part 44 thereof. A first locking member 82 which is displaceable relative to the first connector housing 68, and constitutes a secondary lock, is then displaced so as to engage the latch 76 to prevent it from being displaced out of engagement with the first crimp ferrule 34. This results in the first crimp ferrule 34 and accordingly the first cable sub-assembly 12 being secured relative to the first connector housing 68 as shown in the left hand portion of FIG. 4.

The first seal 33 and strain relief 31 are then slid along the first cable 8 into an outer part of the first passage 72 and held in place by some suitable means, not shown, such as a feature on the strain relief 31 which is securable to the first connector housing.

The second connector housing 70 includes a passage 84 containing ferrule engagement means. The ferrule engagement means is in the form of an inwardly projecting ferrule stop shoulder 86 and a resilient and outwardly displaceable ferrule retaining latch 88 spaced therefrom which constitutes a primary latch. Both the shoulder 86 and the latch 88 are integrally formed with the second connector housing 70. Other constructions are however possible. The ferrule retaining latch could for example be replaced with a latch member which is formed separately from the connector housing 70 and is engageable with the connector housing 70 and the second crimp ferrule 52 to hold it against the ferrule stop shoulder 86 to secure the second crimp ferrule 52 relative to the second connector housing 70. With the arrangement shown in FIG. 3, the second cable sub-assembly 14 is inserted into the second passage 84 until the second crimp ferrule 52 comes into contact with a sloping cam surface 90 of the latch 88. Further insertion of the second cable sub-assembly 14 into the second connector housing 70 causes the latch 88 to be displaced outwardly until a leading end of the second crimp ferrule 52 comes into contact with the ferrule stop shoulder 86 at which point the latch 88 resiles inwardly and engages a rearwardly facing shoulder 92 of the second crimp ferrule 52 situated between the distal part 56 and the proximal part 54 thereof. A second locking member 94, which is displaceable relative to the second connector housing 70, and constitutes a secondary latch, is then displaced so as to engage the latch 88 to prevent it from being displaced out of engagement with the second crimp ferrule 52. This results in the second crimp ferrule 52, and accordingly the second cable sub-assembly 14 being secured relative to the second connector housing 70 as shown in the right hand portion of FIG. 4.

The second seal 51 and strain relief 49 are then slid along the second cable 10 into an outer part of the second passage 84 and held in place by some suitable means, not shown, such as a feature on the strain relief 49 which is securable to the second connector housing 70.

The first part 4 and the second part 6 of the connector 2, assembled as explained above, are then confronted with each other as shown in FIG. 4 ready for connection.

As the first and second parts 4 and 6 of the connector 2 are brought together the second connector housing slides into the first connector housing. The second core connection member 64, which is in the form of a pin connector, passes into the insulation tube 40 of the connector first part 4 and further engagement of the connector parts results in the second core connection member 64 slidingly engaging a passage in the first core connection member 36, which is in the form of a receptacle connector. Finally the shield tube 38 slides into and electrically engages the distal part 56 of the second crimp ferrule 52. As this occurs a distal part of the shield tube 38 displaces the engagement fingers 58 of the second crimp ferrule 52 displacing them slightly outwardly against the inward biasing force of the ring spring 62 which thereafter holds the second crimp ferrule in secure electrical contact with the shield tube 38. A nib 96 on the second connector housing 70 engages an aperture 98 in the first connector housing 68 to hold the connector housings firmly together.

A second embodiment of the invention will now be described with particular reference to FIGS. 5, 6*a* and 6*b*. Parts of the second embodiment which correspond to those of the first embodiment are designated with the same reference numerals and will not necessarily be described in detail. The following description refers mainly to features of the second embodiment which differ from those of the first embodiment. Features and method steps not referred to below can be assumed to be the same as for the first embodiment.

Figure 5:
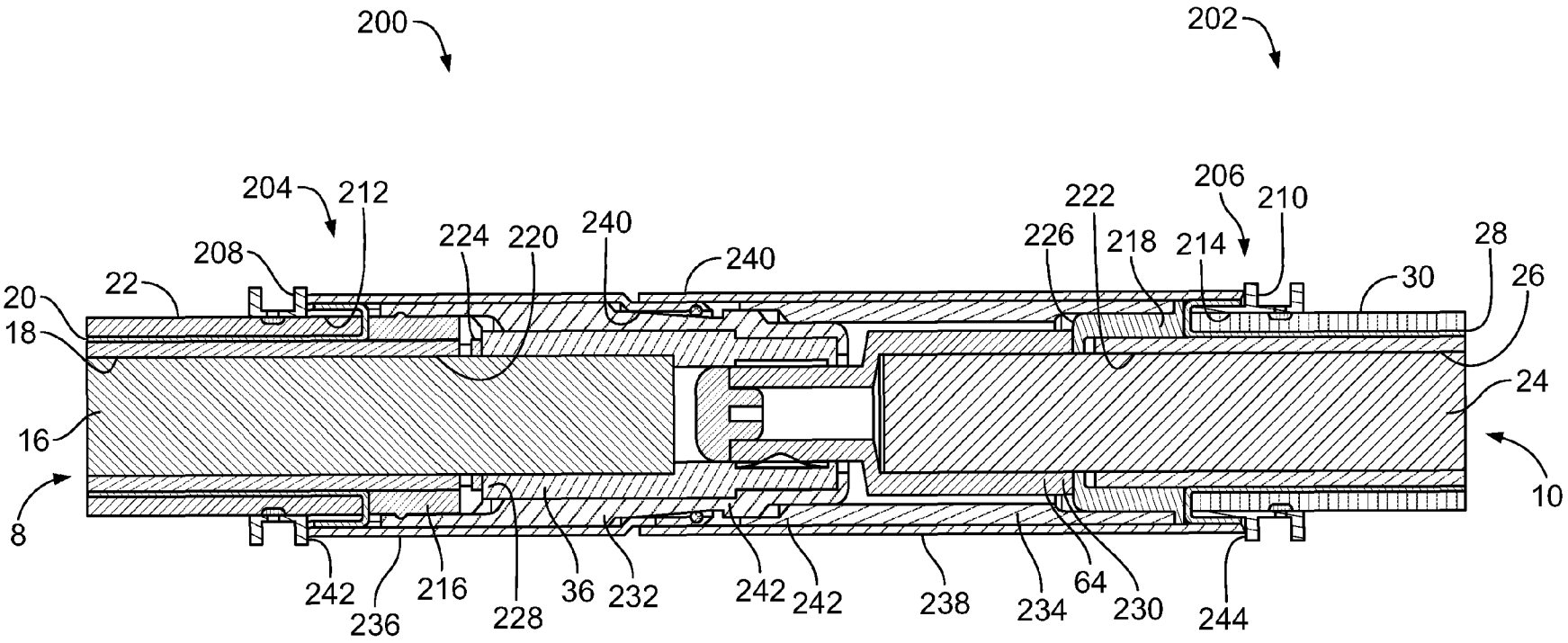
FIG. 5 shows two interengaged cable sub-assemblies which form part of a coaxial cable connector according to a second embodiment of the invention.
Figures 6A, 6B:
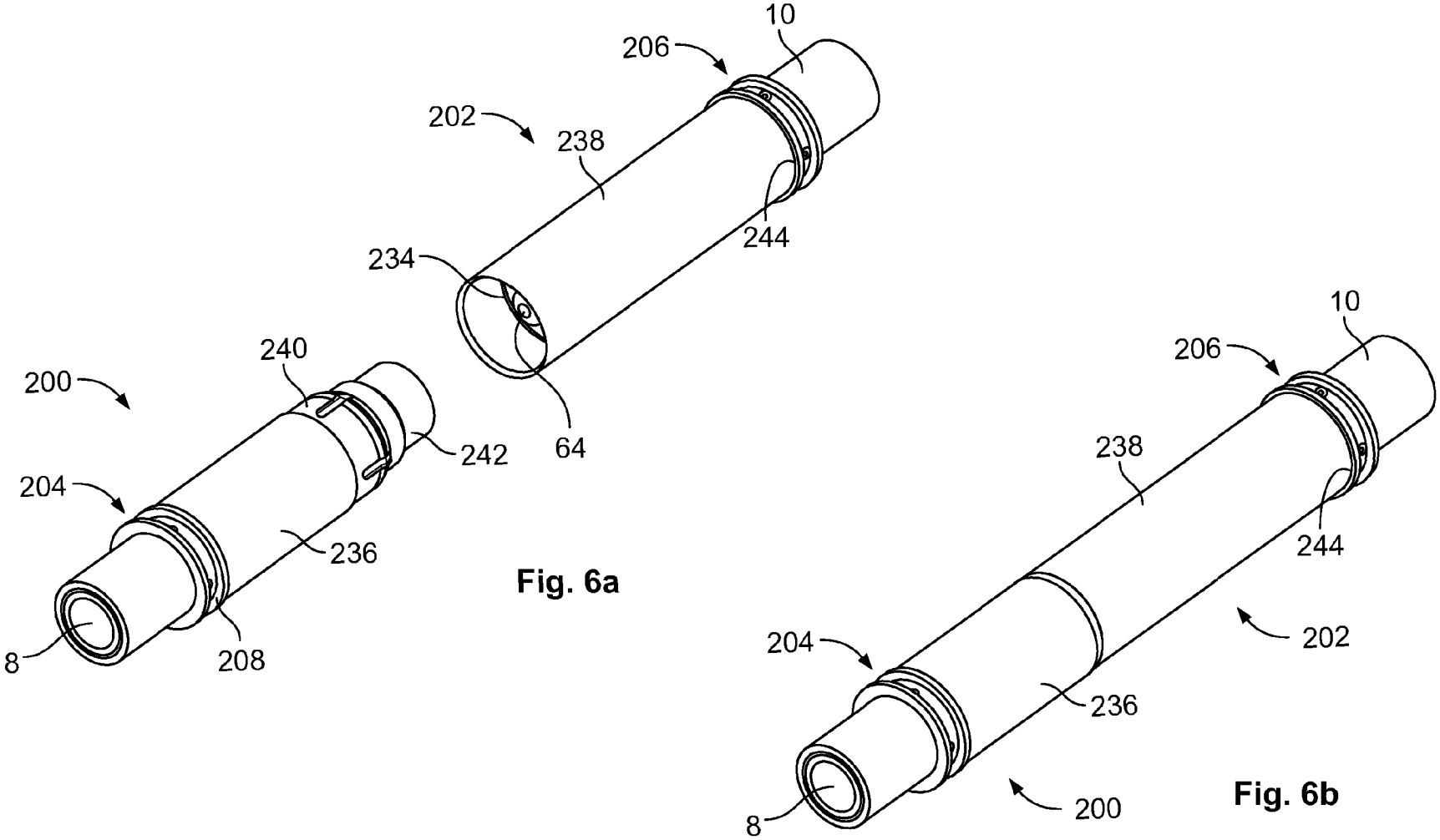
FIG. 6*a* shows the two sub-assemblies shown in FIG. 5 prior to interengagement.
FIG. 6*b* shows the two sub-assemblies shown in FIG. 5 after interengagement.

FIGS. 5 and 6*b* show a first cable sub-assembly 200 and a second cable sub-assembly 202 of the second embodiment engaged with each other and FIG. 6*a* shows these cable sub-assemblies in an unengaged state.

The first cable sub-assembly 200 includes a crimp ferrule 204 with an inner annular part 212 situated around an end of the cut-back outer insulation 22. The crimp ferrule 204 also includes a shoulder 208 which faces away from an end of the cable 8. The braid 20 of the first cable 8 is doubled back and folded so as to overlie the annular part 212 of the first crimp ferrule 204. A first thrust collar 216 of insulating material is slid onto an end 220 of the inner insulation 18 that extends past the cut-back outer insulation 22. A proximal end of the thrust collar 216 abuts a portion of the braid 20 that is folded around the end of the crimp ferrule 214 and a distal end 224 of the thrust collar 216 is inwardly stepped and extends past the end of the inner insulation 18. A first core connection member 36, in the form of a receptacle contact, is then slid over an end of the core 16 that extends past the stripped back inner insulation 18 until a proximal end 228 of the first core connection member 36 contacts the distal end 224 of the first thrust collar 216 and is then crimped onto the core 16. The first thrust collar 216 is accordingly positioned between the first crimp ferrule 204 and the first core connection member 36 and able to transmit load therebetween. A tubular first insulation sleeve 232 is then positioned with a proximal end overlying and latching to the first thrust collar 216 and a first shield sleeve 236 of a conductive material is positioned around the outside of the first insulation sleeve 232 with a proximal end thereof overlying a portion of the annular part 212 of the first crimp ferrule 204 with the folded back portion of the braid 20 positioned therebetween. A portion of the first shield sleeve 236 overlying the first crimp ferrule is then crimped inwardly in order to provide a secure electrical connection between the first shield sleeve 236 and the braid 20. This crimping process will also crimp the first crimp ferrule 204 inwardly so that it grips the first cable 8. A secondary crimp is possible in a recess behind the ferrule shoulder 208. A distal end of the first insulation sleeve 232 comprises an insulation overlap portion 242 and a distal end of the first shield sleeve 236 comprises a shield overlap portion 240. This completes the formation of the first cable sub-assembly 200.

The second cable sub-assembly 202 includes a crimp ferrule 206 with an inner annular part 214 situated around an end of the cut-back outer insulation 30. The crimp ferrule 206 also includes a shoulder 210 which faces away from an end of the cable 10. The braid 28 of the second cable 10 is doubled back and folded so as to overlie the annular part 214 of the second crimp ferrule 206. A second thrust collar 218 of insulating material is slid onto an end 222 of the inner insulation 26 that extends past the cut-back outer insulation 30. A proximal end of the thrust collar 218 abuts a portion of the braid 28 that is folded around the end of the crimp ferrule 206 and a distal end 226 of the thrust collar 218 is inwardly stepped and extends past the end of the inner insulation 26. A second core connection member 64, in the form of a pin contact, is then slid over an end of the core 24 that extends past the stripped back inner insulation 26 until a proximal end 230 of the first core connection member 64 contacts the distal end 226 of the second thrust collar 218 and is then crimped onto the core 24. The second thrust collar 218 is accordingly positioned between the second crimp ferrule 206 and the second core connection member 64 and able to transmit load therebetween. A tubular second insulation sleeve 234 is then positioned with a proximal end overlying and latching to the second thrust collar 218 and a second shield sleeve 238 of a conductive material is positioned around the outside of the second insulation sleeve 234 with a proximal end thereof overlying a portion of the annular part 214 of the second crimp ferrule 206 with the folded back portion of the braid 28 positioned therebetween. A portion of the second shield sleeve 238 overlying the second crimp ferrule is then crimped inwardly in order to provide a secure electrical connection between the second shield sleeve 238 and the braid 28. This crimping process will also crimp the second crimp ferrule 206 inwardly so that it grips the second cable 10. A secondary crimp is possible in a recess behind the ferrule shoulder 210. A distal end of the second insulation sleeve 234 comprises an insulation overlap portion 242 and a distal end of the second shield sleeve 238 comprises a shield overlap portion 240. This completes the formation of the second cable sub-assembly 202.

The first and second connector housings into which the cable sub-assemblies described above are secured are not illustrated but will be broadly similar to the connector housings 68 and 70 of the first embodiment. Movement of the first cable sub-assembly 200 into the first connector housing will be limited by a forwardly facing abutment surface 242 on the first crimp ferrule 204, which projects outwardly past the first shield sleeve 236, abutting against a ferrule stop shoulder (74 in the first embodiment) in the first connector housing. A first ferrule retaining latch (76 in the first embodiment) will engage the shoulder 208 of the first crimp ferrule 204, in the same manner as in the first embodiment, to secure the first cable sub-assembly 200 in the first connector housing. As in the first embodiment a locking member will be provided to hold the latch in engagement with the first crimp ferrule 204. The second cable sub-assembly 202 will be secured in a second connector housing in a like manner. A forwardly facing abutment surface 244 is provided on the second crimp ferrule 206 and projects outwardly past the second shield sleeve 238 for abutting against a ferrule stop shoulder in the second connector housing.

When the first and second connector housings are brought into engagement with each other the first and second core connection members 36 and 64 will become engaged with each other as in the first embodiment. In addition the shield overlap portions 240 of the shield sleeves 236 and 238 will become engaged with each other and the insulation overlap portions 242 of the insulation sleeves 232 and 234 will become engaged with each other as shown in FIG. 5. When the connector housings are so engaged and latched together the cable sub-assemblies 200 and 202 will be engaged as shown in FIG. 5. In this state each core connection member is secured firmly in the connector housing by being held by the associated thrust collar, which is held in place by the associated crimp ferrule, which in turn is secured to the connector housing.

The embodiments described above provide a straight coaxial cable connector which is compact and can be made from fewer parts than corresponding prior art connectors. The embodiments have been described for the purpose of illustration only and should not be construed as limiting the invention. Furthermore it should be noted that features of one embodiment may be used in combination with features from the other embodiment.

The invention claimed is:

1. Straight electrical coaxial cable connector for connecting first and second coaxial cables along a longitudinal axis, and each including a core and a shield layer, the connector including first and second interconnectable housing parts, first and second crimp ferrules for respectively engaging the shield layers of the first and second cables, shield connection means for electrically interconnecting the first and second shield layers, core connection means for electrically interconnecting the two cores, and first and second ferrule engagement means operable to respectively secure the first and second ferrules relative to the longitudinal axis and to respective said housing parts, and further including tubular insulating means interposed between the shield connection means and the core connection means, the tubular insulating means comprises a one-piece insulation tube which extends from the first crimp ferrule to the second crimp ferrule.

2. The connector of claim 1 wherein each ferrule engagement means is integrally formed with one of said housing parts.

3. The connector of claim 1 further including at least one displaceable secondary lock member which has the ability to engage with a respective ferrule engagement means.

4. The connector of claim 1, wherein the shield connection means comprises tubular shield connection means.

5. The connector of claim 4 wherein the tubular shield connection means comprises a one-piece shield tube which extends from the first crimp ferrule to the second crimp ferrule.

6. Straight electrical coaxial cable connector for connecting first and second coaxial cable each including a core and a shield layer, the connector including first and second interconnectable housing parts, first and second crimp ferrules for respectively engaging the shield layers of the first and second cables, shield connection means for electrically interconnecting the first and second shield layers, core connection means for electrically interconnecting the two cores, and first and second ferrule engagement means operable to respectively secure the first and second ferrules relative to respective said housing parts, wherein at least one of the crimp ferrules comprises a main ferrule body and spring means arranged to bias the main ferrule body into engagement with the shield connection means.

7. The connector of claim 6, wherein at least one of the crimp ferrules comprises a main ferrule body and spring means arranged to bias the main ferrule body into engagement with the shield connection means.

8. The connector of claim 1 wherein the tubular insulation means includes an insulation tube mounted in each housing part, the two insulation tubes including overlapping engagement portions.

9. The connector of claim 5 wherein the core connection means includes two interconnectable core connector members each configured to be connected to a respective one of the cores and situated within the one-piece shield tube.

10. The connector of claim 1 wherein at least one of the crimp ferrules comprises a main ferrule body and spring means arranged to bias the main ferrule body into engagement with the shield connection means.

11. The connector of claim 10 wherein the main ferrule body includes plural longitudinally extending engagement portions and the spring means surrounds and inwardly biases the engagement portions.

12. The connector of claim 1 wherein the core connection means includes two interconnectable core connector members each configured to be connected to a respective one of the cores and wherein a thrust collar is interposed between at least one of the crimp ferrules and a respective one of the core connector members for biasing the core connector members into engagement with each other.

13. The connector of claim 1 wherein in place of the first and second ferrule engagement means the connector includes first and second ferrule or shield connection means engagement means.

14. A method of interconnecting two aligned coaxial electrical cables each including a core and a shield layer, the method comprising the steps of:

(i) forming a cable sub-assembly at an end of each cable including engaging a crimp ferrule with the shield layer and joining a core connection member to the core of the respective cable;

(ii) providing shield connection means for electrically interconnecting the shield layers;

(iii) providing two interconnectable housing parts;

(iv) securing each cable sub-assembly relative to a respective housing part with an engagement means which engages one said crimp ferrule or said shield connection means; and (v) interconnecting the housing parts such that the core connection members interconnect the cores and the shield connection means interconnects the shield layers, wherein the step of forming each cable sub-assembly includes the step of positioning a thrust collar between the crimp ferrule and the core connection member which transfers load therebetween when the sousing parts are interconnected.

15. The method of claim 14 wherein the step of providing the shield connection means comprises providing a one-piece shield tube which extends from one crimp ferrule and has the ability to engage with the other crimp ferrule when the housings are interconnected.

16. The connector of claim 6, wherein the core connection means includes two interconnectable core connector members each configured to be connected to a respective one of the cores and wherein a thrust collar is interposed between at least one of the crimp ferrules and a respective one of the core connector members for biasing the core connector members into engagement with each other.

17. The connector of claim 6, wherein in place of the first and second ferrule engagement means the connector includes first and second ferrule or shield connection means engagement means.

18. The connector of claim 6, wherein each ferrule engagement means is intergrally formed with one of said housing parts.

19. The connector of claim 6, further including at least one displaceable secondary lock member which has the ability to engage with a respective ferrule engagement means.

20. The connector of claim 6, wherein the shield connection means comprises tubular shield connection means.

21. The connector of claim 20, wherein the tubular shield connection means comprises a one-piece shield tube which extends from the first crimp ferrule to the second crimp ferrule.

22. The connector of claim 6, further including tubular insulating means interposed between the shield connection means and the core connection means.

23. The connector of claim 22, wherein the tubular insulating means comprises and one-piece insulation tube which extends from the first crimp ferrule to the second crimp ferrule.

24. The connector of claim 22, wherein the tubular insulation means includes and insulation tube mounted in each housing part, the two insulation tubes including overlapping engagement portions.

25. The connector of claim 21, wherein the core connection means includes two interconnectable core connector members each configured to be connected to a respective one of the cores and situated within the one-piece shield tube.

26. The connector of claim 7, wherein the main ferrule body includes plural longitudinally extending engagement portions and the spring means surrounds and inwardly biases the engagement portions.

* * * * *